US005475574A

United States Patent [19]

Chien

[11] Patent Number: 5,475,574

[45] Date of Patent: Dec. 12, 1995

[54] SHOULDER BAND WITH AN EL LIGHT STRIP

[76] Inventor: Tseng-Lu Chien, 8th Fl.-6, No. 9, San Min Rd., Taipei, Taiwan

[21] Appl. No.: 226,322

[22] Filed: Apr. 12, 1994

[51] Int. Cl.[6] ..... F21L 15/08

[52] U.S. Cl. ..... 362/108; 362/84; 362/156; 362/189; 362/191; 362/806; 190/115

[58] Field of Search ..... 362/84, 103, 108, 362/253, 267, 276, 278, 320, 806, 154, 156, 157, 158, 189, 190, 191; 116/202, DIG. 44; 150/107; 190/115

[56] References Cited

U.S. PATENT DOCUMENTS

| | | | |
|---|---|---|---|
| 3,153,745 | 10/1964 | Gurian et al. | 362/84 |
| 4,774,642 | 9/1988 | Janko et al. | 362/108 |
| 4,895,110 | 1/1990 | LoCascio | 362/108 |
| 5,067,063 | 11/1991 | Granneman et al. | 362/84 |
| 5,073,844 | 12/1991 | Coyner et al. | 362/156 |
| 5,245,516 | 9/1993 | de Haas et al. | 362/84 |
| 5,245,517 | 9/1993 | Fenton | 362/156 |
| 5,249,106 | 9/1993 | Barnes et al. | 362/108 |

FOREIGN PATENT DOCUMENTS

| | | | |
|---|---|---|---|
| 4101595 | 7/1992 | Germany | 362/154 |

*Primary Examiner*—Ira S. Lazarus
*Assistant Examiner*—Alan B. Cariaso
*Attorney, Agent, or Firm*—Bacon & Thomas

[57] ABSTRACT

A lighted shoulder strap includes a hook, buckle, or slider for attaching the strap to a bag, purse, or suitcase. An EL strip is attached to the strap by, for example, stitching or glue, to allow the wearer to be more visible at nighttime, particularly by motor vehicles, without detracting from the attractiveness of the strap, and a length adjustment clip and shoulder pad are included to ensure comfort for the wearer.

5 Claims, 5 Drawing Sheets

FIG. 4
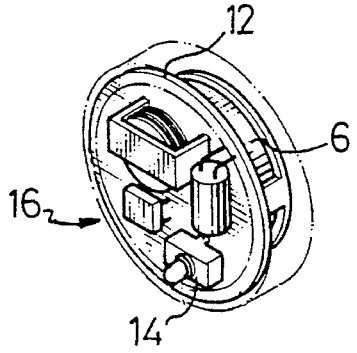
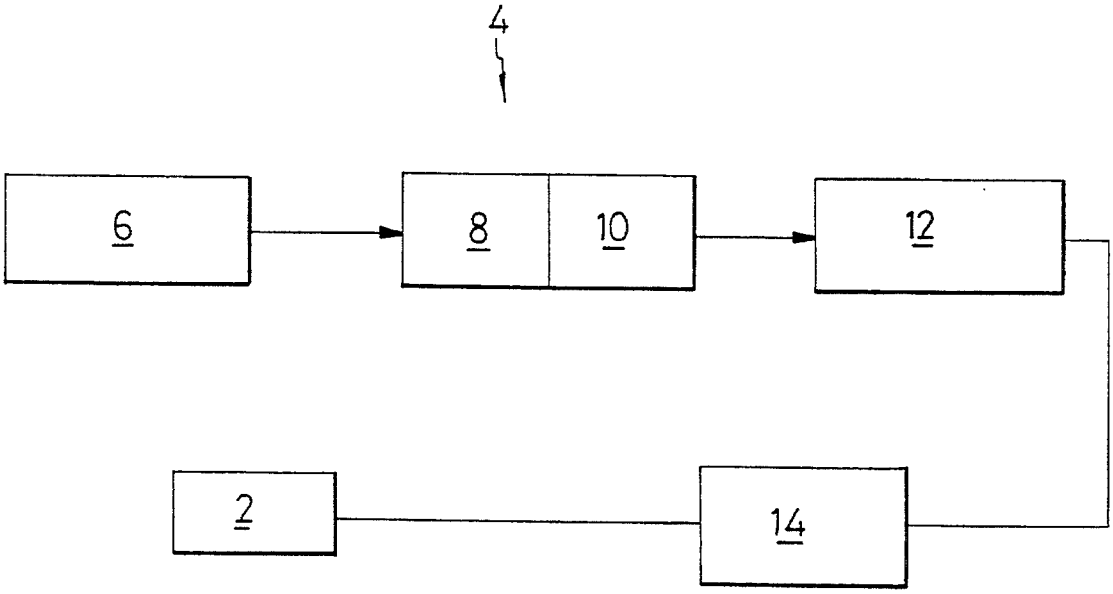
FIG. 2

SHOULDER BAND WITH AN EL LIGHT STRIP

BACKGROUND OF THE INVENTION

U.S. Pat. Nos. 3,153,745, 4,774,642, 4,895,110, 5,067,063, 5,245,516, and 5,249,106 disclose illumination arrangements similar to that of the present invention, except that none discloses the combination of 1) an electroluminescent lighted shoulder to which the electroluminescent strip is stitched, glued, or taped, and 2) means for attaching the strap to a bag.

SUMMARY OF THE INVENTION

A lighted shoulder strap is made up of a shoulder strap, shoulder pad, end connector, adjustment clips, one or more electroluminscent light strips, a soft & stitchable sleeve, and a power pack.

The shoulder strap includes means for adjusting its length for carrying a bag and a shoulder pad to distribute weight pressure to a wider area. One or more adjustable clips can be used to let a consumer adjust the length as needed. On each end of the strip is a hook, slider, or buckle type end connector to let the shoulder strap be connected to a bag, purse, suitcase, sporting bag etc.

The electroluminescent light strip has a strip dimension which fits into a soft, stitchable sleeve attached on the shoulder strap by glue, stitching, or Velcro tape. The electroluminest light strip requires an electric input and trigger to be illuminated. A power pack is arranged to let the flexible light have a desired light performance. All electric components are concealed inside of power pack with an on/off switch for system turn on and off.

The power pack consists of a housing for storage of all electric components inside of it. The electric components include a transformer, switch, function interface parts, and a D.C. power source. The transformer converts the D.C. power source current to an alternating current at a voltage and frequency sufficient to trigger the electroluminscent light strip to be illuminated. The function control interface parts may consist of several resistors, capacitors, transistors, diodes, and other electric components for obtaining different light performance functions such as flashing, random flash, steady state fade in-out, and sequential light shows. A switch can be used to sense the tilt, vibration, ambient light, or simply to let the system to be connected or disconnected from the power source.

The lighted shoulder strap has a high brightness and offers a consumer safety signal to all moving vehicles. This low cost device will protect people during dark area activities.

The present invention provides a useful illuminated shoulder strap that has great flexibility, is unbreakable, has low power consumption, is easily manufactured, and provides a wide color choice.

These and other features of the invention will become clear from an inspection of the detailed description of the invention and from the appended claims.

BRIEF DESCRIPTION OF THE DRAWINGS

FIG. I is a perspective view of a first embodiment of an electroluminscent light strip of the present invention which is attached to a first type of bag in accordance with prior art;

FIG. 2 is a block diagram of a circuit for powering the electroluminscent light strip of the present invention;

FIG. 4 is a perspective view of a housing in which the circuit is received;

DETAILED DESCRIPTION OF EMBODIMENTS

Figure 1:
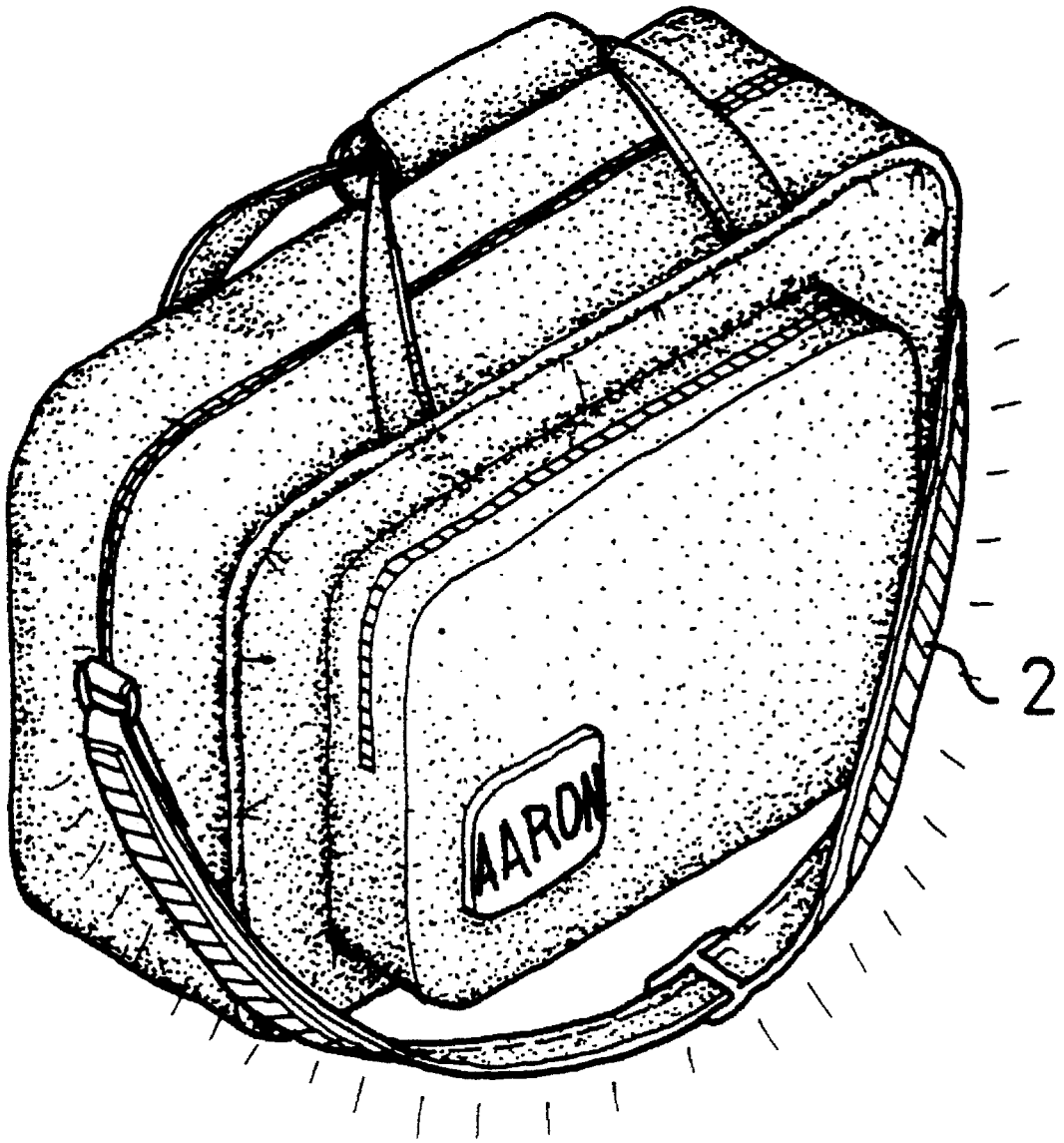

Referring to FIG. 1, an electroluminscent light strip 2, which is taught in the applicant's co-pending U.S. patent application Ser. No. 08/156,004, now abandoned, is attached to a shoulder strap 1 of a bag by means of sewing, gluing, etc.

Figure 3:
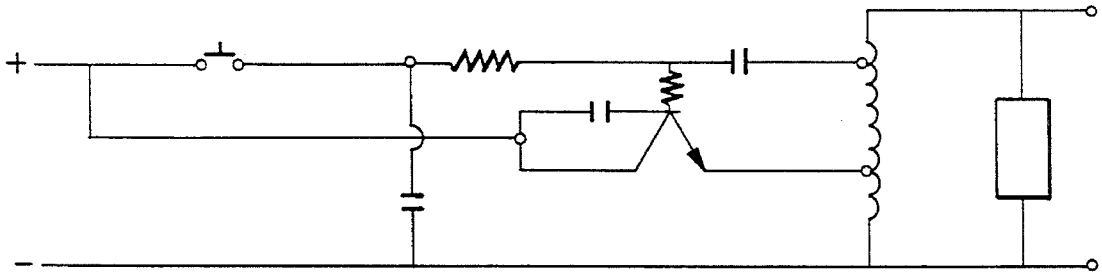
FIG. 3 shows the circuit for powering the electroluminscent light strip.

Referring to FIGS. 2 and 3, the electroluminscent light strip 2 is powered by means of a circuit 4. The circuit 4 includes a direct current (DC) power supply 6 which is connected to an alternating-current-to-direct-current convertor 8 (DC/AC convertor). The DC/AC convertor 8 is connected by means of a transformer 10 to a function interface 12. The function interface 12 is connected by means of a switch 14 to the electroluminscent light strip 2.

The DC power supply 6 is used to provide electricity for the electroluminscent light strip 2. For convenience, the DC power supply 6 is preferably a dry battery so that it is easily attached to the shoulder strip.

A direct current is sent from the DC power supply 6 to the DC/AC convertor 8. The direct current is converted into an alternating current by means of the DC/AC convertors. The DC/AC convertor 8 can be selected in order to provide a desired frequency of the alternating current.

The alternating current is sent from the DC/AC convertor 8 to the transformer 10. The voltage of the AC signal is sent increased by means of the transformer 10.

The voltage-increased AC is sent from the transformer 10 to the function interface 12. The function interface 12 provides a plurality of options (known to those skilled in the art) which include "regular short interval flashing", "permanent 'ON'", "regular short interval flashing interspersed with regular 'OFF' periods", "irregular interval flashing", and "phased-in and phased-out flashing". Various ways in which the electroluminscent light strips flash are possible because of the function interface 12. The function interface 12 can be an integral circuit or any other means.

The electroluminscent light strips can be turned on and off by a means of the switch 14.

Referring to FIG. 4, the dry battery 6, the DC/AC convertor 8, the transformer 10, the function interface 12 and the switch 14 are contained in a housing 16.

Figure 5:
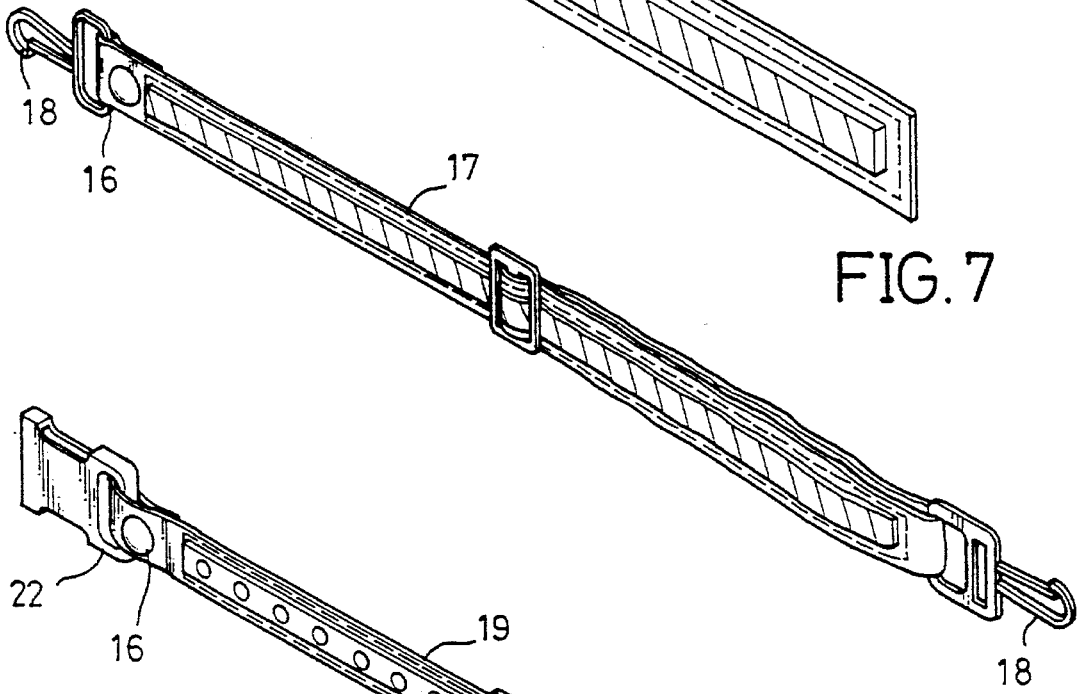

Referring to FIG. 5, a shoulder strap 17 uses two hooks 18 each of which is attached to one of two ends of the shoulder strap 17. Both the electroluminscent light strip 2 and housing 16 are attached to the shoulder strap 17.

Figure 6:
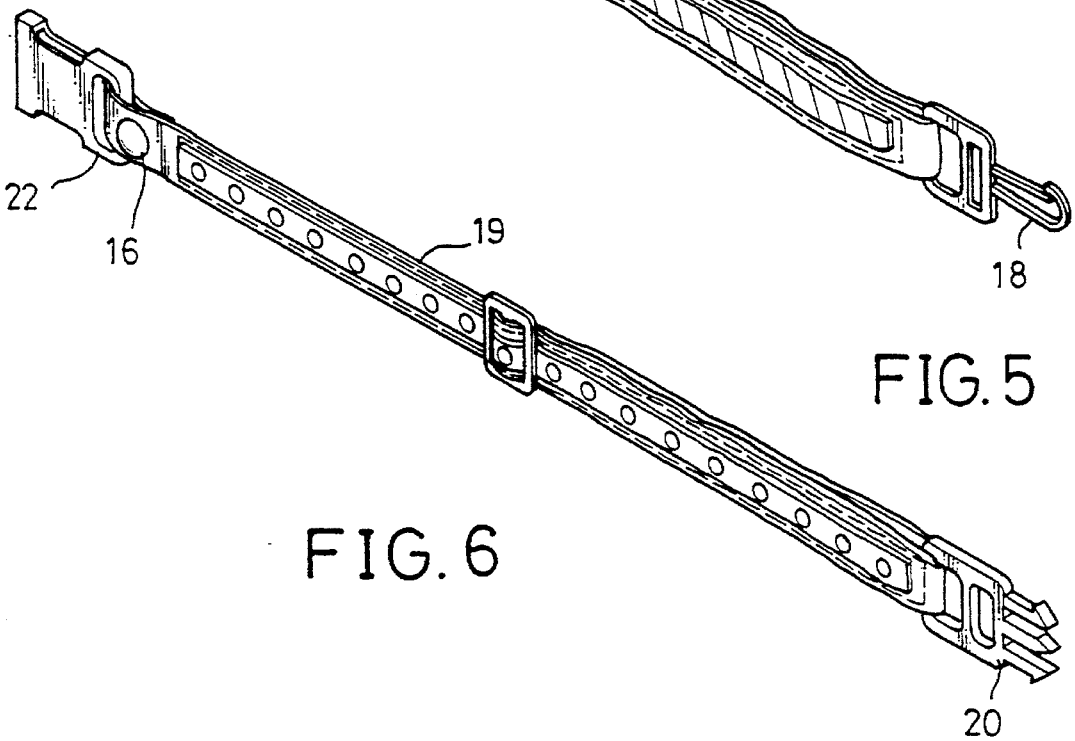
Figure 8:
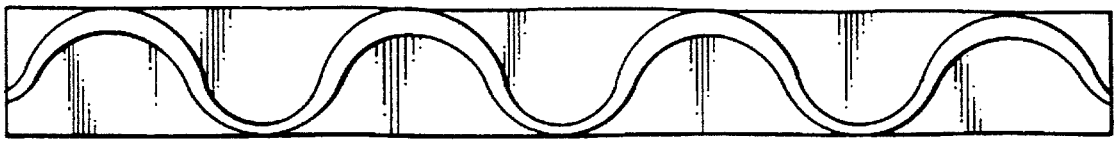
FIGS. 8–11 show four additional embodiments of the electroluminscent light strip of the present invention.
Figure 9:
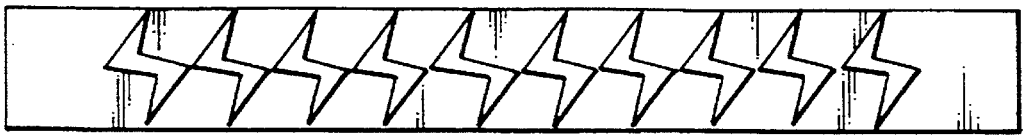
Figure 10:
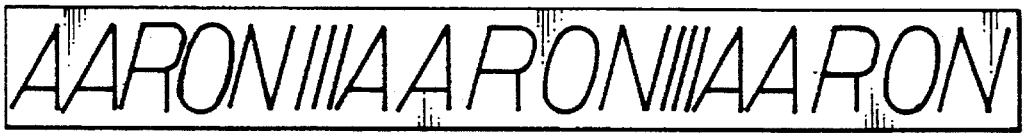
Figure 11:
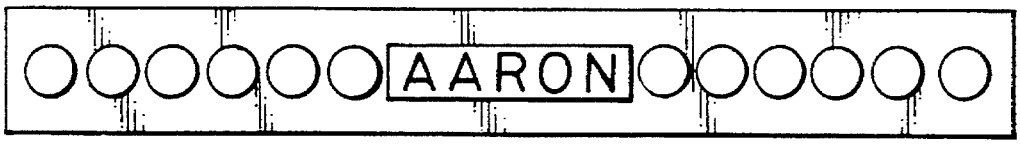

Referring to FIG. 6, a shoulder strap 19 uses a pair of snapping anchors 20 at a first end and a hook receiver 22 at a second end. The electroluminscent light strip 2 is attached to the shoulder strap 19. The housing 16 is attached to the first type of shoulder strap 19.

Figure 7:
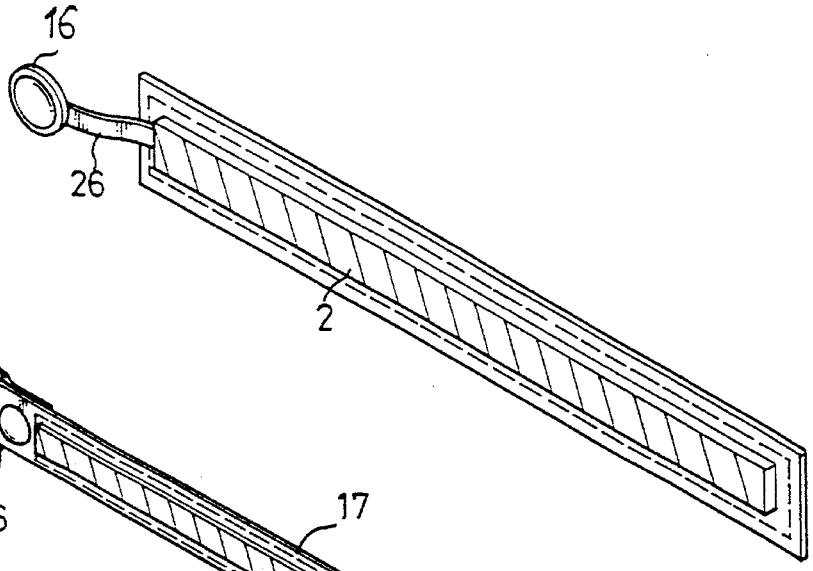
FIGS. 5–7 show three shoulder straps which each use an electroluminscent light strip.

Referring to FIG. 7, the electroluminscent light strip 2 is attached to a shoulder strap 24. But, the housing 16 is not directly attached to the shoulder strap 24. The electroluminscent strip 2 is connected to the switch 14 by means of a wire (not shown) which is enclosed in a strap 26.

FIGS. 8–11 show four transparent enclosures 28, 30, 32 and 34. Each of the enclosures is printed with a different pattern.

What is claimed is:

1. A lighted shoulder strap arrangement, comprising:

a shoulder strap;

means including a connector on at least one end of the strap for connecting the strap to a bag;

an electroluminscent strap enclosed by a soft, stitchable transparent sleeve;

a power pack contained within a housing; and means for affixing the sleeve and power pack on the strap, said power pack including a DC battery, a DC/AC converter, an light activating control circuit, and a housing with a removable decorative cover.

2. A lighted shoulder strap as claimed in claim 1, wherein the connector is selected from the group consisting of a slider connector, buckle, hook or *Velcro*™, for attaching the strip to a variety of different types of bag, including purses and suitcases.

3. A lighted shoulder strap as claimed in claim 1, wherein said power back housing is waterproof and encloses all electrical components required for controlling activation of said electroluminescent strip.

4. A lighted shoulder strap as claimed in claim 1, further comprising means including a clip for adjusting a length of the strap, and a shoulder pad.

5. A lighted shoulder strap as claimed in claim 1, wherein said means for affixing the sleeve to the strap is selected from the group consisting of stitching, glue, *Velcro*™, or double-sided tape.

* * * * *